US006112354A

United States Patent [19]

Stoltz et al.

[11] Patent Number: 6,112,354

[45] Date of Patent: Sep. 5, 2000

[54] SUCTION POWERED CLEANER FOR SWIMMING POOLS

[75] Inventors: Herman Stoltz, Gauteng, South Africa; Ronald J. Sargent, Cape Coral, Fla.

[73] Assignee: Polaris Pool Systems, Inc., Vista, Calif.

[21] Appl. No.: 09/176,532

[22] Filed: Oct. 21, 1998

[51] Int. Cl.[7] ..... E04H 4/16

[52] U.S. Cl. ..... 15/1.7; 15/246; 210/169

[58] Field of Search ..... 15/1.7, 246; 210/169

[56] References Cited

U.S. PATENT DOCUMENTS

| | | |
|---|---|---|
| 3,803,658 | 4/1974 | Rubenheimer . |
| 3,822,754 | 7/1974 | Henkin et al. . |
| 4,023,227 | 5/1977 | Chauvier . |
| 4,133,068 | 1/1979 | Hofmann . |
| 4,152,802 | 5/1979 | Chauvier . |
| 4,156,948 | 6/1979 | Chauvier et al. . |
| 4,208,752 | 6/1980 | Hofmann . |
| 4,351,077 | 9/1982 | Hofmann . |
| 4,463,468 | 8/1984 | Chauvier . |
| 4,530,125 | 7/1985 | Hofmann . |
| 4,536,908 | 8/1985 | Raubenheimer . |
| 4,558,479 | 12/1985 | Greskovics et al. . |
| 4,589,986 | 5/1986 | Greskovics et al. . |
| 4,642,833 | 2/1987 | Stoltz et al. . |
| 4,656,683 | 4/1987 | Raubenheimer . |
| 4,734,954 | 4/1988 | Greskovics et al. . |
| 4,742,593 | 5/1988 | Kallenbach . |
| 4,761,848 | 8/1988 | Hofmann . |
| 4,769,867 | 9/1988 | Stolz . |
| 4,807,318 | 2/1989 | Kallenbach . |
| 4,949,419 | 8/1990 | Kallenbach . |
| 5,014,382 | 5/1991 | Kallenbach . |
| 5,265,297 | 11/1993 | Gould et al. . |
| 5,315,728 | 5/1994 | Atkins . |
| 5,337,433 | 8/1994 | Gould et al. . |
| 5,404,607 | 4/1995 | Sebor . |
| 5,418,995 | 5/1995 | Rice et al. . |
| 5,421,054 | 6/1995 | Dawson et al. . |
| 5,433,985 | 7/1995 | Atkins . |
| 5,450,645 | 9/1995 | Atkins . |
| 5,465,443 | 11/1995 | Rice et al. . |
| 5,617,606 | 4/1997 | Scott, II et al. . |
| 5,634,229 | 6/1997 | Stoltz . |

*Primary Examiner*—Terrence R. Till
*Assistant Examiner*—Jennifer McNeil
*Attorney, Agent, or Firm*—Kelly Bauersfeld Lowry & Kelley, LLP

[57] ABSTRACT

An improved suction powered cleaner is provided for vacuuming dirt and debris from submerged floor and side wall surfaces of a swimming pool. The cleaner comprises a head defining a suction inlet for vacuum inflow of water and debris into a plenum chamber, and further through a primary suction tube adapted for connection via a vacuum hose to a conventional pool water filtration system. An oscillatory main control valve is pivotally mounted at an upstream end of the primary suction tube and spring-loaded toward a normal open position relative to an annular valve seat. Suction flow through the primary suction tube draws the control valve toward a closed position substantially interrupting water flow, whereupon the control valve returns by spring action to the normal open position, resulting in pressure fluctuations which cause the cleaner to advance in steps over submerged pool surfaces. The cleaner head may also include a bypass suction tube having a normally closed bypass valve responsive to pressure fluctuations within the primary suction tube for alternately opening when the main control valve is substantially closed, and vice versa. A perforated flexible disk is carried by and extends radially outwardly from the cleaner head to contact the surrounding submerged pool surface, and a laterally extending part-circle steering apron overlies a selected arcuate segment of the disk so that the disk is vacuum-retained against the submerged surface with an asymmetric force causing the cleaner head to advance along a nonlinear path.

46 Claims, 9 Drawing Sheets

SUCTION POWERED CLEANER FOR SWIMMING POOLS

BACKGROUND OF THE INVENTION

This invention relates generally to automatic pool cleaning devices for travel over submerged surfaces of a swimming pool or the like to pick up and collect accumulated debris such as leaves, twigs, sand and silt. More particularly, this invention relates to an improved pool cleaner of the so-called suction or vacuum powered type, having means for cyclic interruption of water flow to generate pulsating forces which cause the pool cleaner to advance in steps over submerged floor and side wall surfaces of a swimming pool. The suction powered pool cleaner of the present invention includes improved drive means for generating the requisite pulsating forces to drive the cleaner in a reliable manner, with reduced risk of stalling upon ingestion of large debris.

Pool cleaner devices are generally well known in the art for use in maintaining residential and commercial swimming pools in a clean and attractive condition. In this regard, swimming pools conventionally include a water filtration system including a pump for drawing or suctioning water from the pool for circulation through a filter canister having filter media therein to remove and collect water-entrained debris such as leaves and twigs as well as fine particulate including sand and silt. From the filter canister, the water is recirculated to the pool via one or more return lines. Such filtration system is normally operated for several hours on a daily basis and serves, in combination with traditional chemical treatments such as chlorination or the like, to maintain the pool water in a clean and clear sanitary state. However, the water filtration system is ineffective to filter out debris which settles onto submerged floor and side wall surfaces of the swimming pool. In the past, settled debris has typically been removed by coupling a vacuum hose to the suction side of the pool water filtration system, such as by connecting the vacuum hose to a skimmer well located near the water surface at one side of the pool, and then manually moving a vacuum head coupled to the hose over the submerged pool surfaces to vacuum settled debris directly to the filter canister where it is collected and separated from the pool water. However, manual vacuuming of a swimming pool is a labor intensive task and is thus not typically performed by the pool owner or pool cleaning service personnel on a daily basis.

Automatic pool cleaner devices have been developed over the years for cleaning submerged pool surfaces, thereby substantially eliminating the need for labor intensive manual vacuuming. Such automatic pool cleaners typically comprise a relatively compact cleaner housing or head coupled to the pool water filtration system by a hose and including water-powered means for causing the cleaner to travel about within a swimming pool to dislodge and collect settled debris. In one form, the pool cleaner is connected to the return or pressure side of the filtration system for receiving positive pressure water which powers a turbine for rotatably driving cleaner wheels, and also functions by venturi action to draw settled debris into a filter bag. See, for example, U.S. Pat. Nos. 3,882,574; 4,558,479; 4,589,986; and 4,734,954. In another form, the pool cleaner is coupled to the suction side of the filtration system, whereby water is drawn through the pool cleaner to operate a drive mechanism for transporting the cleaner within the pool while vacuuming settled debris to the filter canister of the pool filtration system. See, for example, U.S. Pat. Nos. 3,803,658; 4,023,227; 4,133,068; 4,208,752; 4,351,077; 4,642,833; 4,742,593; 4,761,848; 4,769,867; 4,807,318; 5,265,297; 5,315,728; 5,450,645; and 5,634,229.

While both positive pressure and suction powered pool cleaners have proven to be generally effective in cleaning settled debris and the like from submerged pool surfaces, various customer preferences and installation considerations have been instrumental in causing an individual customer to choose one cleaner type over the other. More specifically, by comparison, positive pressure type cleaners are generally regarded as providing better collection of large debris such as leaves in a removable filter bag, to prevent such large debris from being drawn into and potentially clogging the filter canister of the pool water filtration system. Positive pressure cleaners are also generally viewed as having superior random travel for improved overall coverage of submerged pool surfaces. Moreover, positive pressure cleaners normally exhibit better periodic back-up or reverse function to resist entrapment in a sharp corner or the like within a pool. However, such positive pressure cleaners often require a booster pump and/or installation of an additional dedicated water return line to be integrated into the filtration system, whereby the overall cost of installing a positive pressure cleaner particularly in an existing pool can be significant. By contrast, a suction side cleaner normally can be coupled by a vacuum hose directly into the existing skimmer well of a pool, for relatively simplified connection to the suction side of the filtration system in a pool that is not equipped with a pre-installed suction side cleaner flow line. Moreover, suction side cleaners are designed for operation without requiring an additional booster pump. Accordingly, suction side cleaners have tended to be somewhat less costly to install, in comparison with pressure side cleaners. However, additional collection devices such as auxiliary leaf canisters and the like are generally required to capture large debris and thereby prevent ingestion of large leaves and the like into the filter canister of the filtration system.

Most suction side cleaners currently available on the market utilize a valve member typically in the form of a diaphragm or shuttle type valve adapted for movement between open and closed positions at a cyclic rate to disrupt the suction flow in a manner creating pressure surges or pulsations of sufficient magnitude to propel the cleaner in a forward direction in a series of incremental steps. However, this valve member has been susceptible to clogging upon ingestion of debris vacuumed from a submerged pool surface. Clogging of the valve member not only results in undesirable stalling or interruption in cleaner operation, but also creates a risk of cavitation and potential failure of the filtration system pump.

There exists, therefore, a significant need for further improvements in pool cleaners of the suction powered type, particularly with respect to providing improved drive means for propelling the cleaner throughout a swimming pool, with reduced risk of clogging in response to ingested debris. Moreover, there exists a need for providing a suction powered pool cleaner designed for enhanced randomness of travel over submerged surfaces of a swimming pool. The present invention fulfills these needs and provides further related advantages.

SUMMARY OF THE INVENTION

In accordance with the invention, an improved pool cleaner of the type powered by a suction or vacuum source is provided for vacuuming debris settled upon submerged floor and side wall surfaces of a swimming pool or the like. The pool cleaner comprises a compact housing or head adapted for connection to a vacuum hose or the like coupled in turn to the suction side of a conventional pool water filtration system. The cleaner head defines a suction inlet through which water and debris are drawn from an underlying pool surface for flow to the vacuum hose. A main control valve is pivotally mounted within the cleaner head for oscillatory motion between an open position and a substantially or nearly closed position relative to an annular valve seat for intermittently disrupting the suction water flow to create pressure fluctuations or pulsations of sufficient magnitude to advance the cleaner head over a submerged pool surface in a series of incremental steps.

More particularly, the cleaner head has a downwardly open lower foot defining the suction inlet, with a flexible perforated mat or disk extending radially outwardly from the head in surrounding relation to the suction inlet. Water is drawn radially inwardly beneath as well as downwardly through the perforated disk to the suction inlet to sweep dirt and debris from an underlying pool surface for flow into a plenum chamber formed within the cleaner head. From the plenum chamber, the water and debris is drawn further through a primary suction tube having an upstream end defining the annular valve seat, and a downstream end coupled to the vacuum hose. The main control valve is pivotally mounted within the plenum chamber for swinging movement between a normal spring-loaded open position spaced substantially to one side of the valve seat, and a substantially closed position to substantially disrupt water flow therethrough. In the preferred form, a stop is provided to prevent complete closure of the main control valve in the substantially closed position.

In operation, water drawn under vacuum through the primary suction tube is effective to draw the main control valve from the normal spring-loaded open position to the substantially closed position, whereupon the water flow through the cleaner head is momentarily disrupted sufficiently to enable the spring-loaded main control valve to return toward the open position. As a result, the control valve is oscillated or reciprocated back-and-forth between the open and closed position in a cyclic manner, to induce a succession of pressure fluctuations or pulsations acting along the axis of the primary suction tube. By orienting the primary suction tube to extend forwardly and upwardly from the plenum chamber, these pressure fluctuations or pulsations have a component of force which is effective to displace the cleaner head generally along a forward path of travel in a series of small steps.

In accordance with further aspects of the invention, the cleaner head may additionally include a bypass suction tube having an upstream end intersecting with the primary suction tube, and a lower or downstream end disposed in close proximity to the perforated disk at a location spaced forward from the foot of the cleaner head. This bypass suction tube provides a secondary suction flow passage for vacuuming debris, particularly such as relatively large debris drawn onto the disk but otherwise too large to pass downwardly through the perforated disk to the suction inlet. A bypass valve is mounted within the bypass suction tube and is resiliently biased to a normal closed position. This bypass valve is oriented to open in response to increased vacuum or negative pressure within the primary suction tube, when the main control valve is in the substantially closed position. Conversely, the spring-loaded bypass valve returns to the closed position in response to decreased vacuum within the primary suction tube, when the main control valve is in the open position. Accordingly, with this construction, the bypass valve cycles between closed and open positions, in opposition respectively to the open and closed positions of the main control valve.

Substantially random travel of the pool cleaner over submerged pool surfaces can be enhanced by forming an asymmetric pattern of perforations in the disk. With this design, vacuum-induced friction between the disk and the underlying pool surface will be nonuniform at the laterally opposed sides of the cleaner head, resulting in a nonlinear forward path of cleaner travel. This nonlinear path of travel also may be produced by mounting the flexible disk on the cleaner head in a manner permitting disk rotation, and by inclusion of a part-circle and imperforate steering apron projecting laterally from one side of the cleaner head to overlie a selected arcuate segment of the disk to close the perforations therein.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
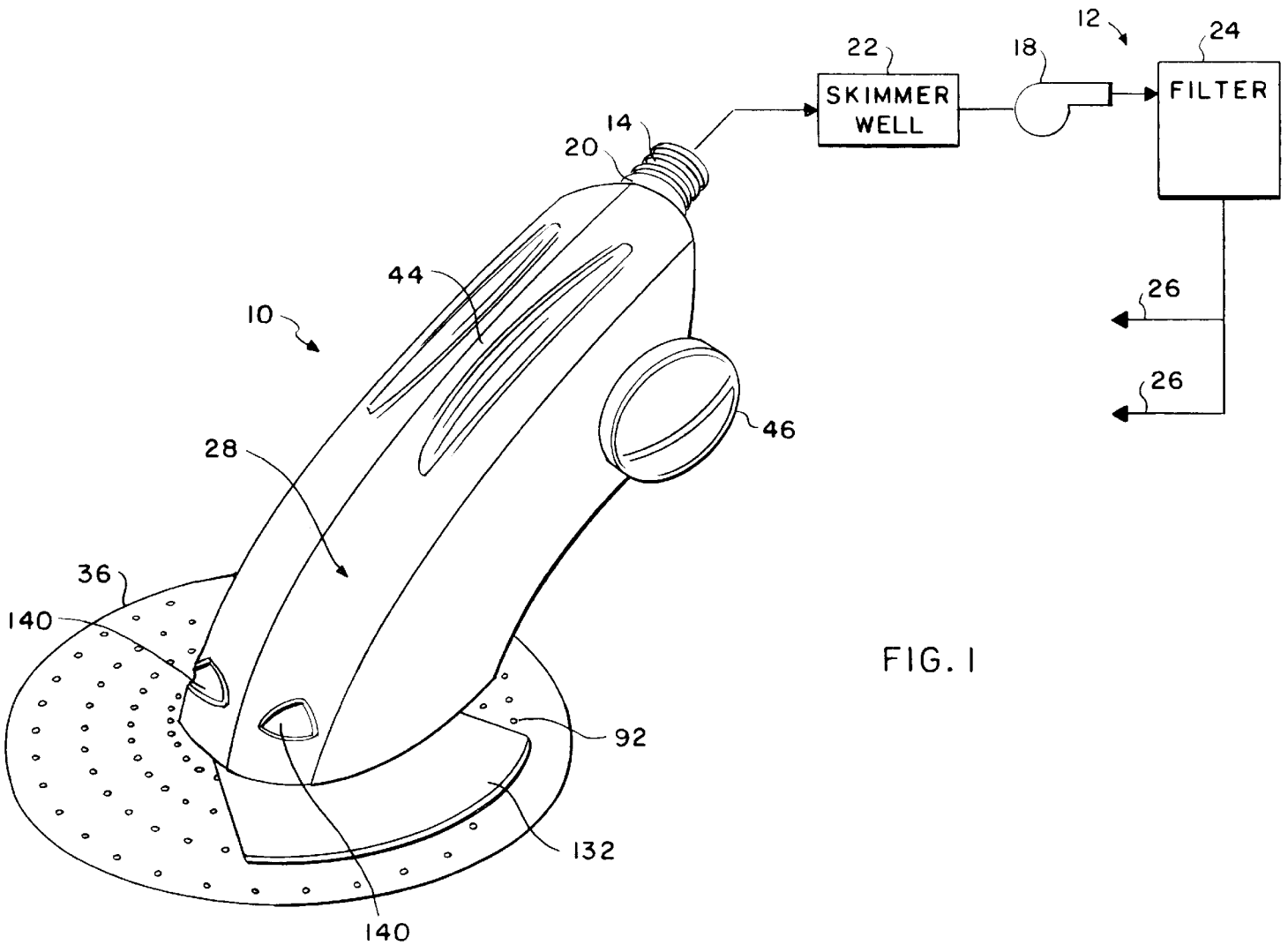
FIG. 1 is a perspective view illustrating a suction powered pool cleaner constructed in accordance with the novel features of the invention, and showing the pool cleaner in operative relation with a conventional pool water filtration system.

As shown in the exemplary drawings, an improved pool cleaner referred to generally in FIG. 1 by the reference numeral 10 is provided for vacuuming debris such as leaves and twigs as well as small particulate such as sand and silt settled onto submerged floor and side wall surfaces of a swimming pool or the like. The pool cleaner 10 is powered by a suction or vacuum source, such as by connection to a conventional pool water filtration system 12 shown schematically in FIG. 1, by means of a vacuum hose 14. In operation, water is drawn through the pool cleaner 10 in a manner for water-borne vacuuming of debris settled onto submerged pool surfaces, and wherein this flow of water provides a power source for driving a main control valve 16 (FIGS. 5–8) in an oscillatory or reciprocatory manner to induce pressure fluctuations or pulsations which drive the cleaner 10 along a forward path of motion in a succession of incremental steps.

The pool cleaner 10 of the present invention is shown in FIG. 1 coupled via the vacuum hose 14 to the suction side of a pump 18 forming part of the pool water filtration system 12. In this regard, the vacuum hose 14 is normally connected between a cylindrical suction fitting 20 on the pool cleaner and a skimmer well 22 mounted typically at one edge of the swimming pool at a location generally at the water's surface. As is well known in the art, the pump 18 draws pool water through the skimmer well 22 (as shown) for discharge flow through a filter canister 24 having a suitable filter media (not shown) therein for filtering and collecting water-entrained debris and particulate. From the filter canister 24, the water is recirculated to the swimming pool typically through a plurality of return lines 26. When the pool cleaner 10 is coupled by the vacuum hose 14 to the skimmer well 22, the pump 18 draws water under a vacuum or negative pressure through the cleaner, wherein this suction water flow is utilized for powering the pool cleaner to travel about in a substantially random pattern within the pool while vacuuming debris settled onto submerged pool surfaces for collection within the filter canister 24. Alternately, it will be recognized and understood that some swimming pools may be equipped with a dedicated suction cleaner flow line (not shown) coupled directly from the pool wall to the filtration system 12, in which case the vacuum hose 14 would be coupled to said suction flow line.

Figure 2:
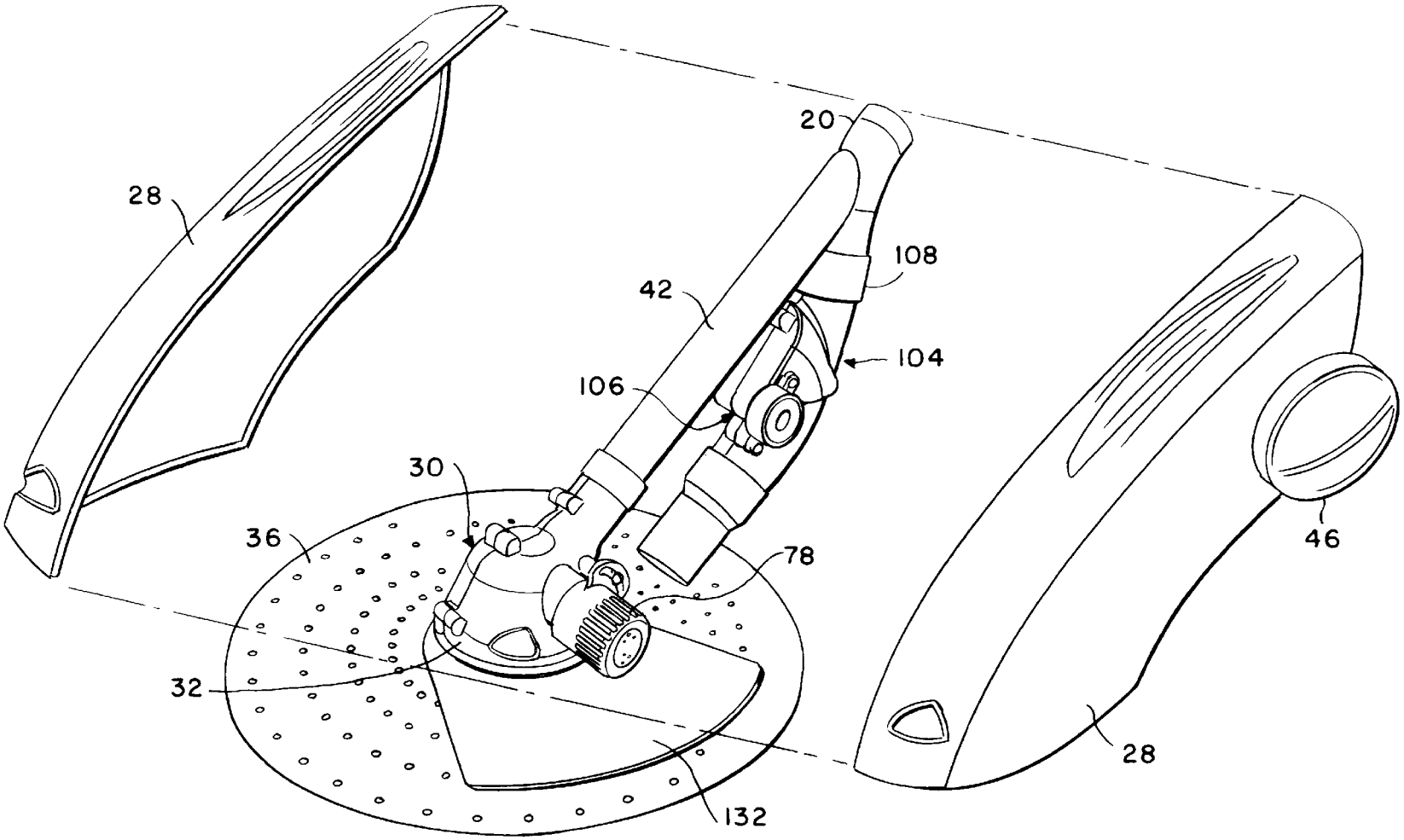
FIG. 2 is an exploded perspective view of the pool cleaner shown in FIG. 1, illustrating an outer housing shell in exploded relation to an internal cleaner head.

As shown in FIGS. 1 and 2, the pool cleaner 10 generally comprises a relatively compact outer housing 28 encasing or mounted about an inner housing or head 30. The head 30 includes a lower foot 32 defining a downwardly open suction inlet 34 (FIG. 6) for vacuum inflow of water-borne debris, wherein the foot 32 is surrounded by a generally circular and relatively flexible mat or disk 36 adapted to drape downwardly about the suction inlet 34 to engage the underlying pool surface 38, as shown in dotted lines in FIGS. 3 and 4. Water-borne debris is drawn through the suction inlet 34 (FIG. 6) initially into a relatively large plenum chamber 40, and then through a primary suction tube 42 which is oriented at an incline to extend angularly upwardly and forwardly from the foot 32 for appropriate connection to the vacuum hose 14. In this regard, the suction fitting 20 (FIGS. 1 and 2) preferably comprises a swivel coupling for connecting the upper or downstream end of the primary suction tube 42 to the vacuum hose 14. The outer housing 28 conveniently comprises a relatively lightweight and decorative outer shell of molded plastic components or the like, shaped if desired to include an accessible handle 44 for lifting and carrying the pool cleaner 10. In addition, FIGS. 1 and 2 show the outer housing 28 to include at least one nose wheel 46 rotatably carried at a front edge of the cleaner for rollingly engaging a vertically extending pool side wall surface during cleaner operation, as will be described in more detail.

Figure 3:
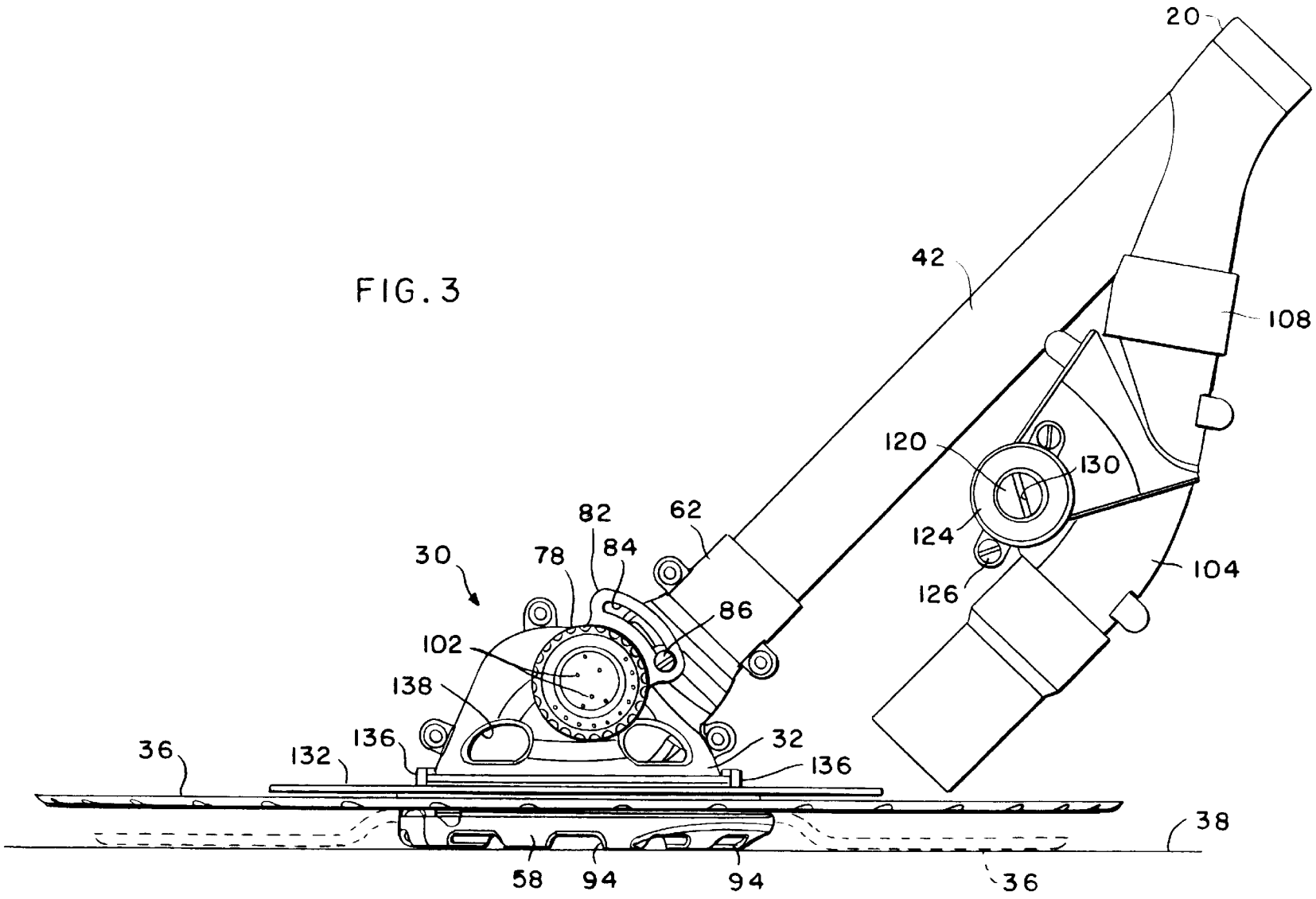
FIG. 3 is a left side elevational view of the cleaner head.
Figure 4:
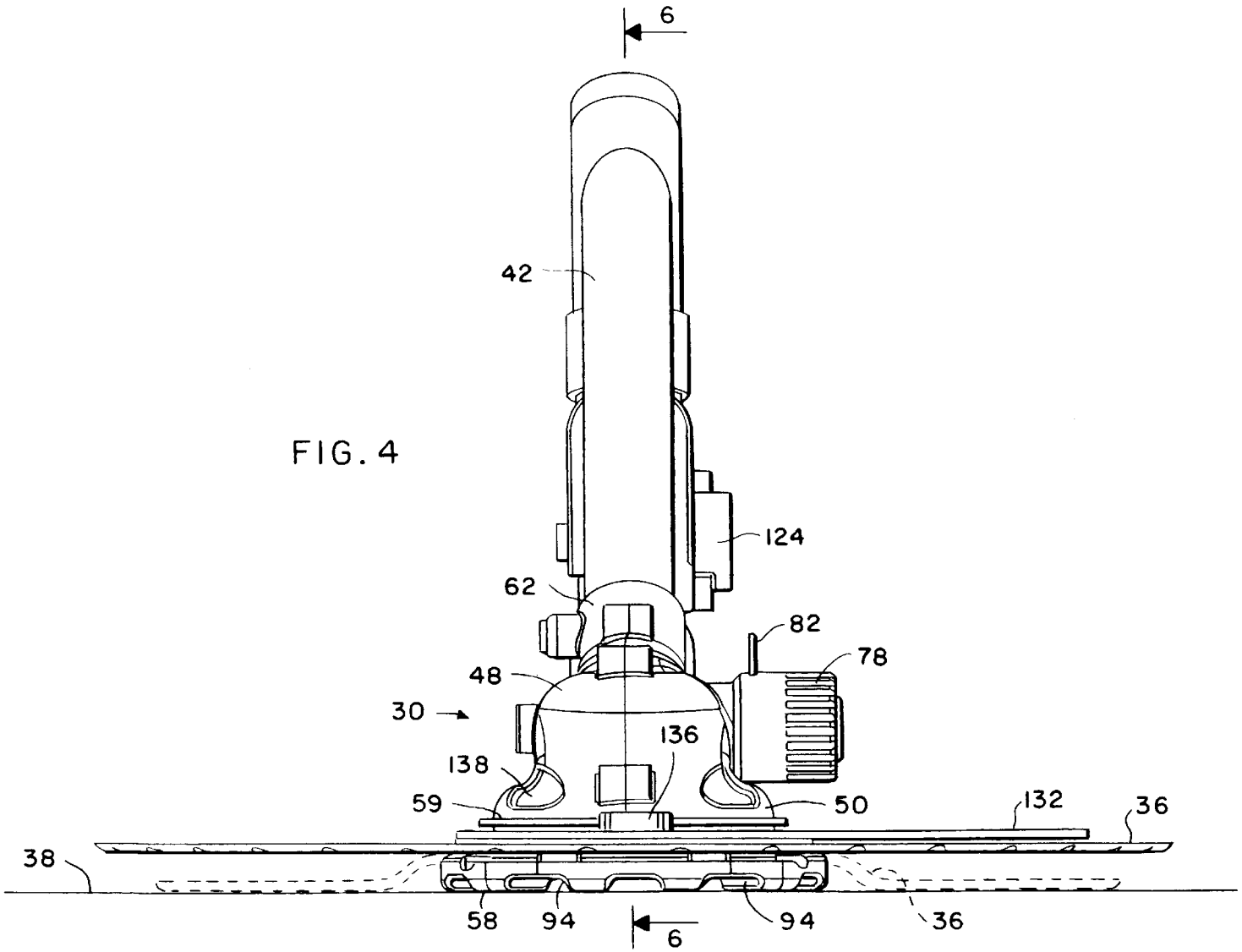
FIG. 4 is a rear elevational view of the cleaner head.
Figure 5:
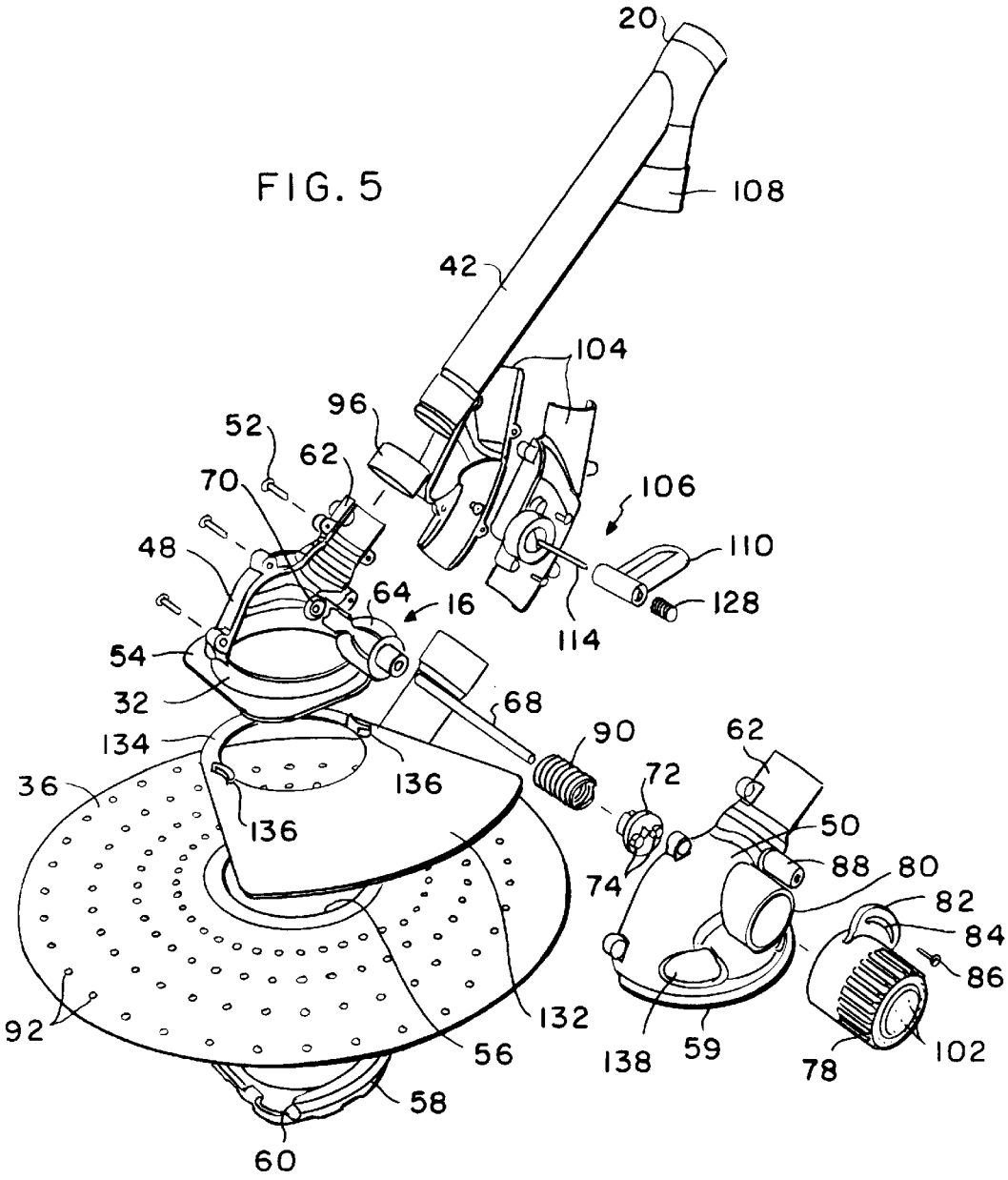
FIG. 5 is an exploded perspective view of the cleaner head.

As shown in more detail in FIGS. 3–5, the internal cleaner head 30 also comprises a pair of generally shell-shaped housing members 48 and 50 of molded plastic or the like and adapted for interconnection by screws 52 (FIG. 5) or the like to form a generally dome-shaped and downwardly open structure defining the plenum chamber 40. In the preferred arrangement, the housing member 48 further includes the lower foot 32 of generally annular shape defining the downwardly open suction inlet 34 (FIG. 6) through which water-borne debris is drawn into the plenum chamber 40. A lower margin of the foot 32 includes a radially outwardly extending flange 54 adapted to fit through a central opening 56 formed in the resilient disk 36. In this regard, the disk 36 is formed from a sufficiently resilient plastic or rubber material so that the opening 56 therein can be stretched sufficiently to fit over the foot flange 54. The foot flange 54 is then seated within a ring-shaped shoe 58, as by sliding reception into and snap-fit retention within a generally U-shaped channel 60 to lock the shoe 58 against the underside of the disk 36 surrounding the disk opening 56 as viewed best in FIGS. 3, 4, 6 and 7. The second housing member 50 can then be assembled with the first housing member 48 by means of the screws 52, wherein the two housing members 48, 50 cooperatively define a radially outwardly extending lock rim 59 (FIGS. 4 and 5) spaced a short distance above the foot flange 54 to engage the upper edge of the disk 36 bounding the disk opening 56.

The assembled housing members 48, 50 of the inner cleaner head 30 also define a cylindrical suction fitting or port 62 (FIGS. 5–8) which forms an outlet at an upper zone of the plenum chamber 40 opening in a direction inclined vertically upwardly and angularly forwardly relative to the foot 32 and the suction inlet 34 defined thereby. This suction fitting 62 is coupled in a suitable manner to a lower or upstream end of the primary suction tube 42 which also forms a portion of the inner cleaner head 30. As shown, the primary suction tube 42 extends further upwardly and forwardly at the same angle of inclination, terminating in an upper or downstream end for connection by the suction fitting 20 to the vacuum hose 14.

The main control valve 16 is pivotally supported by the assembled housing members 48, 50 within the plenum chamber 40, at a position generally at the lower or upstream end of the primary suction tube 42. More specifically, as shown best in FIGS. 5–8, the control valve 16 in one preferred form comprises a valve head 64 shaped to include a part-spherical ball-type surface segment 66 mounted onto a laterally extending shaft 68. One end of the valve shaft 68 is supported by a bushing 70 (FIGS. 5 and 8) on the first housing member 48, and the opposite shaft end carries a spring key 72. This spring key 72 includes an outboard face with a pair of laterally outwardly projecting lugs 74 adapted for seated reception within a corresponding pair of arcuate slots 76 (FIG. 8) formed in an inboard face of an adjustment cap 78. The adjustment cap 78 is sized to fit over a generally cylindrical and laterally open mounting collar 80 formed on the second housing member 50, with a side wing 82 on the cap 78 having an arcuate track 84 therein adapted to receive a lock set screw 86 fastened into a lock post 88. This side wing 82 can thus be accessed from the exterior of the cleaner head and rotationally positioned and then clamped via the set screw 86 relative to the lock post 88, for variably adjusting the rotational position of the cap 78 and the spring key 72 supported therein relative to the mounting collar 80 and the axis of the valve shaft 68. A biasing spring 90 of suitable geometry is provided, such as the illustrative coil spring with opposite ends carried within anchor slots 91 and 93 (FIG. 8) formed respectively in the spring key 72 and in the valve head 64 for rotatably biasing the valve head in one direction.

Figure 6:
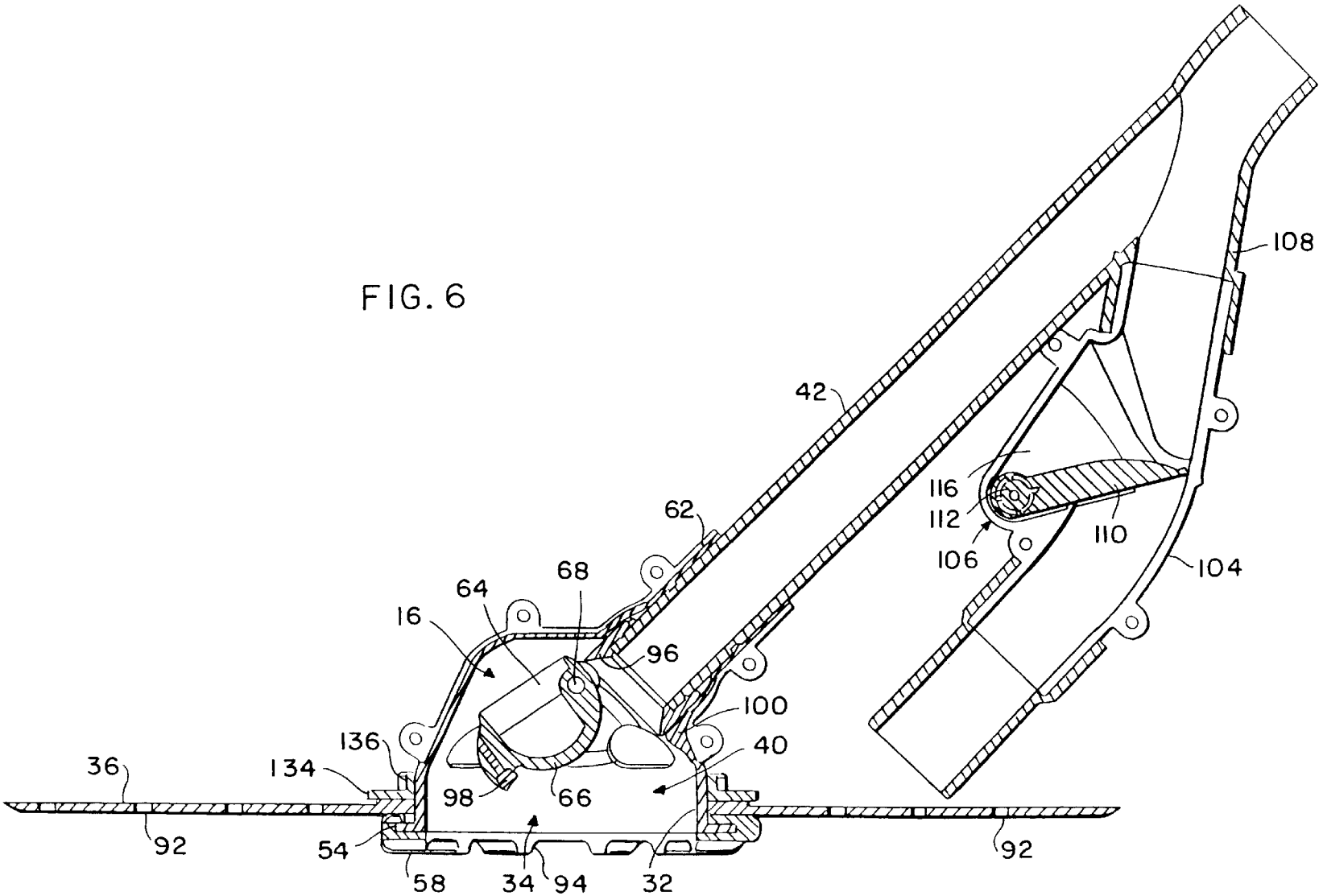
FIG. 6 is a longitudinal vertical sectional view taken generally on the line 6—6 of FIG. 4, and illustrating a main control valve in an open position for regulating water flow through a primary suction tube.

The valve shaft 68 extends laterally through the plenum chamber 40 at a location to extend generally across an upper marginal edge of the open upstream end of the primary suction tube 42, as viewed in FIG. 6. In addition, the ball segment 66 of the valve head 64 is carried off-axis relative to the axis of the valve shaft 68, with the biasing spring 90 urging the valve head 64 to swing the ball segment 66 away from the primary suction tube 42 toward the normally open position. In this normally open position, the upstream lower end of the primary suction tube 42 is substantially open and unobstructed for vacuum inflow of water-borne debris from the plenum chamber 40. In this regard, the axis of the valve shaft 68 is shown to be disposed slightly beyond a straight line flow path defined by the primary suction tube 42. Accordingly, in the normally open position, the valve head 64 is positioned substantially to one side of an axial centerline through the primary suction tube 42, to permit substantially unobstructed flow of water-borne debris through said suction tube.

During operation of the pool cleaner 10, water is drawn by vacuum through the suction inlet 34 into the plenum chamber 40. In this regard, the resilient disk 36 carried by the lower foot 32 normally drapes downwardly about the shoe 58 to engage the pool surface 38 surrounding the cleaner head. Water is drawn radially inwardly beneath the disk 36, and also drawn downwardly through an array of perforations 92 formed in the disk 36, and further through a series of downwardly open notches 94 (FIGS. 3, 4, 6 and 7) formed in the shoe 58 to sweep debris from the pool surface into the plenum chamber 40. The water-borne flow of debris, at negative pressure, passes into the open upstream end of the primary suction tube 42 and further to the vacuum hose 14 for flow to the pool filtration system (FIG. 1) which separates and captures the debris while returning filtered water to the pool.

Importantly, as the water-borne debris flows from the plenum chamber 40 into the primary suction tube 42, a pressure differential attributable to the comparatively smaller flow area of the suction tube 42 and resultant higher velocity water flow therein, relative to the plenum chamber 40, draws the ball segment 66 of the valve head 64 toward a substantially closed position. More particularly, as viewed in FIG. 7, as the suction flow entering the tube 42 reaches a critical velocity, this pressure differential rapidly draws the ball segment 66 into close proximity with a resilient annular valve seat 96 mounted at the upstream end of the primary suction tube 42, whereupon water flow into the suction tube 42 is substantially obstructed. In the preferred form, a stop 98 such as an adjustably set stop screw is carried by the valve head 64 for contacting an abutment 100 within the plenum chamber 40 to prevent complete closure of the ball segment 66 onto the valve seat 96, whereby there is at least some water flow to the suction tube 42 at all times.

As the valve head 64 is abruptly halted at the substantially closed position upon impact contact between the stop 98 and the abutment 100, the sudden loss of momentum in combination with momentary changes in pressure across the valve head enables the biasing spring 90 to swing the valve head 64 rapidly in an opposite direction away from the valve seat 96, toward the open position. This opening movement is accompanied by resumed substantially unobstructed flow of water and debris to the primary suction tube 42 for a brief interval, followed by vacuum-drawn swinging movement of the valve head back toward the substantially closed position. Return closure motion of the valve head 64 is typically assisted by the coil biasing spring 90 which, upon opening movement of the valve head 64 past a static at-rest open position, partially winds the spring 90 in an opposite direction to apply an initial spring force urging the valve head 64 to move back toward the valve seat 96. Accordingly, the valve head 64 is driven in a cyclic or oscillatory fashion, between the open and substantially closed positions. This results in a rapid succession of pressure fluctuations or pulsations within the cleaner head, to induce a water hammer effect acting in the direction of the water flow, namely, upwardly and forwardly generally along the axis of the primary suction tube 42. These pulsations effectively drive or transport the cleaner head in a generally forward direction within the swimming pool, in a series of small incremental hop-like steps to traverse submerged pool surfaces to vacuum debris settled thereon. As the cleaner 10 is driven forwardly in this manner, water-borne debris is swept from the pool surface 38 and through the primary suction tube 42, with minimal risk of clogging or fouling the interface between the valve head 64 and the annular valve seat 96. That is, in the open position, the valve head 64 is substantially out of alignment with the flow to and through the primary suction tube 42. In the substantially closed position, at least some continued flow is permitted through the space between the valve head 64 and the valve seat 96 to avoid capture of debris and potential interruption of reciprocatory valve head movement. In this regard, such risk of clogging is further reduced by forming the valve seat 96 from a resilient material having a relatively thin or sharp leading edge as shown, adapted to undergo some flexing in response to these pressure fluctuations as the valve head 64 moves to and from the substantially closed position. Moreover, the use of the resilient valve seat 96 substantially without direct physical or impact contact with the valve head 64 effectively prevents wear of the valve seat and valve head thereby serving to prolong the service life of the pool cleaner.

The specific operating characteristics of the pool cleaner are dependent upon a variety of factors, including the vacuum pressure applied via the vacuum hose 14. In addition, the cyclic rate of the valve head movement can be adjusted by variably setting the force applied to the valve head 64 by the biasing spring 90. In this regard, the arcuate track 84 in the side wing 82 of the adjustment cap 78 permits rotatable adjustment of the torsion type biasing spring 90, for selectively increasing or decreasing the applied biasing force as desired. Moreover, in accordance with one further aspect of the invention, the laterally presented base of the adjustment cap 78 may be perforated to include small apertures 102 (FIG. 5), to accommodate a low circulatory water flow therethrough. This low rate circulation of water through the adjustment cap 78 has been found effective to reduce or eliminate accumulation of fine grit therein, wherein such grit accumulation could otherwise interfere proper operation of the biasing spring 90.

As shown in FIGS. 5–7 and 9, the cleaner head 30 may optionally and additionally include a bypass suction tube 104 having a bypass valve 106 mounted therein for coordinated operation with the main control valve 16. More specifically, the primary suction tube 42 may be formed to include a Y-shaped junction 108 near the upper end thereof for removable mounting of the bypass suction tube 104 which, when employed, extends downwardly therefrom generally in parallel relation beneath the primary tube 42. The bypass suction tube 104 terminates in a lower end spaced a short distance above the resilient disk 36, at a location forward from the foot 32 and related suction inlet 34. This lower end of the bypass suction tube defines a secondary or bypass inlet designed for vacuum-drawn inflow of water and relatively large debris which can tend to collect on the upper face of the disk 36 as the cleaner head moves forwardly within the swimming pool.

Figure 7:
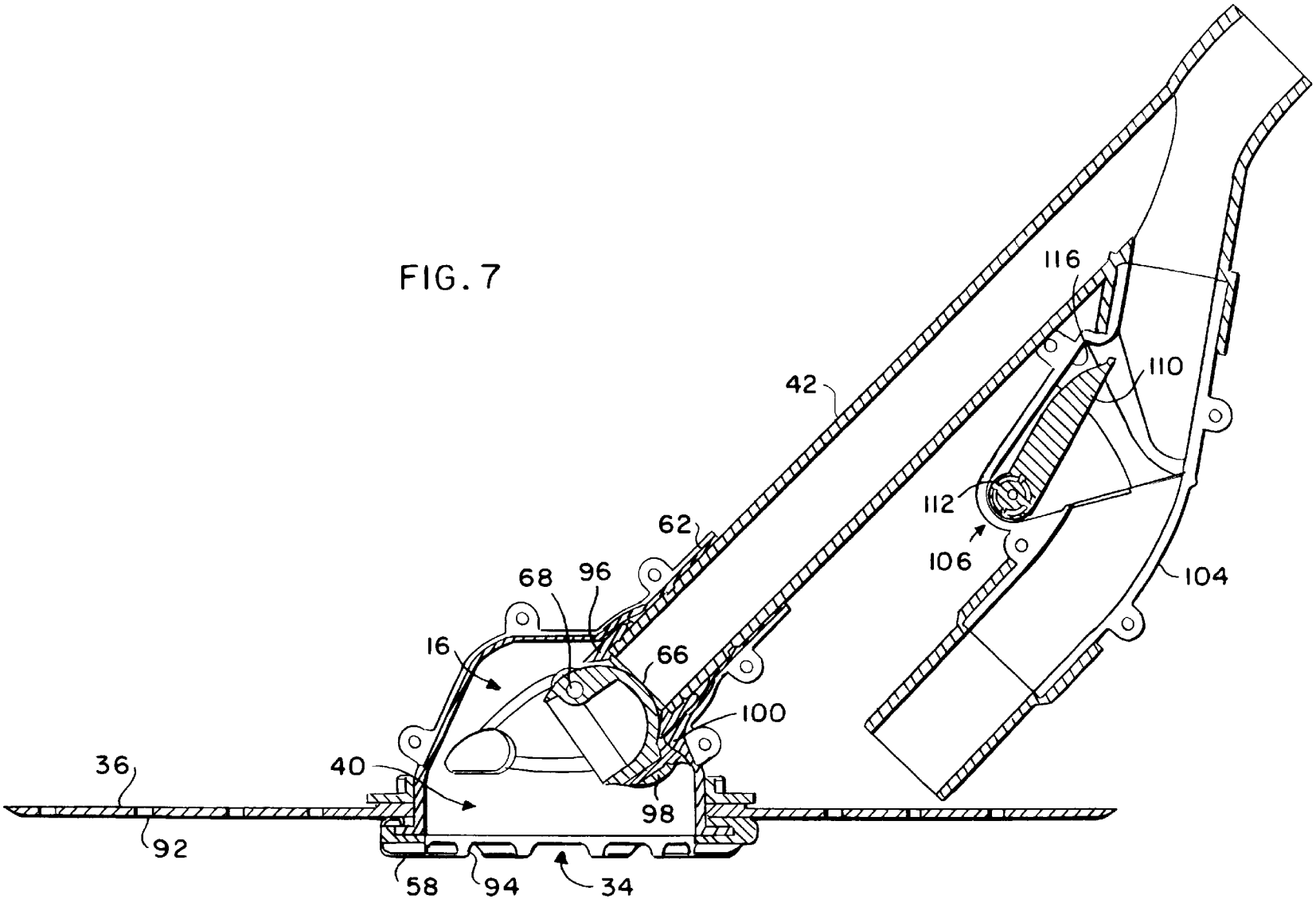
FIG. 7 is a longitudinal vertical sectional view similar to FIG. 6, but depicting the main control valve is a substantially closed position.
Figure 8:
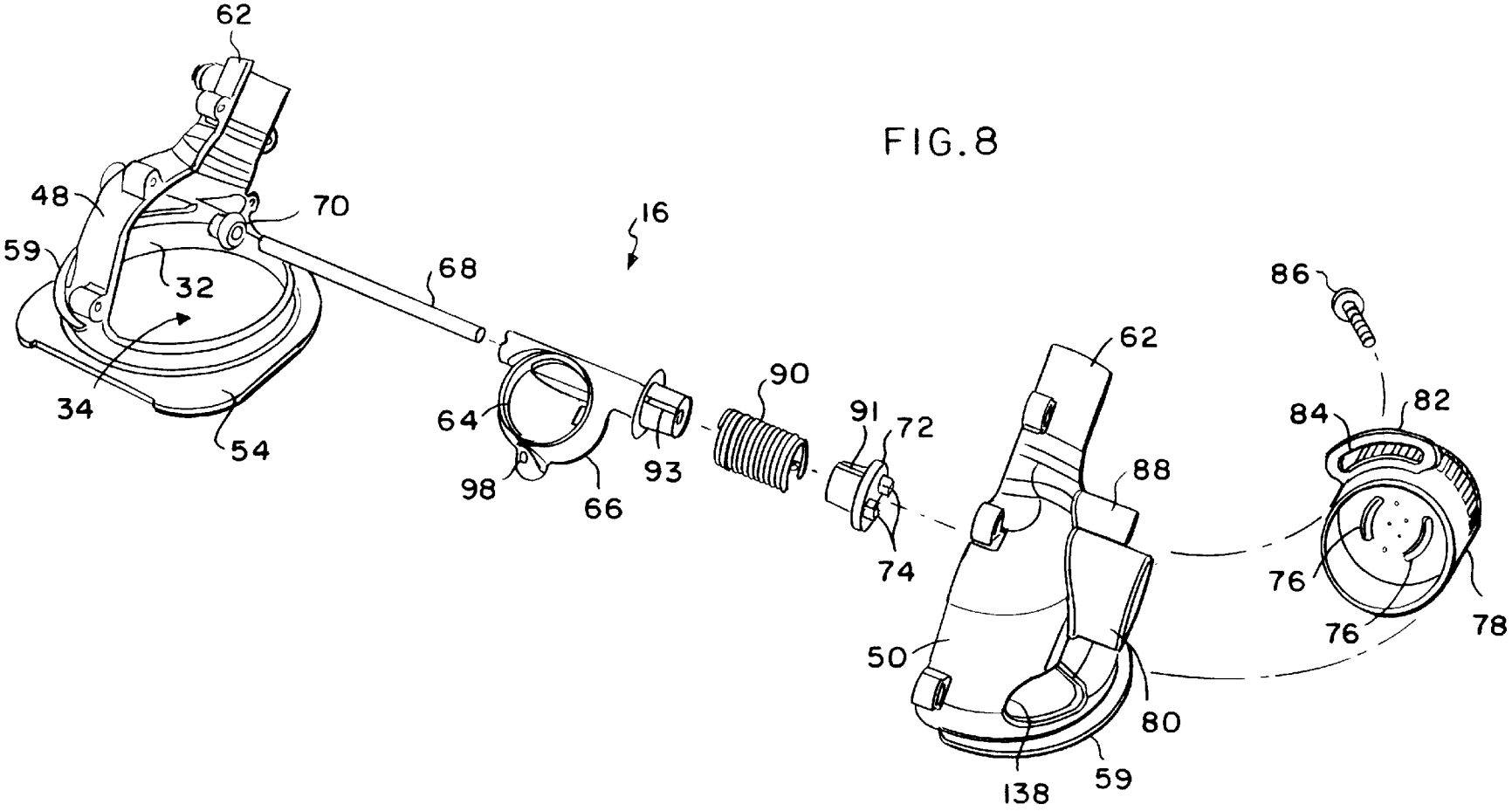
FIG. 8 is an enlarged exploded perspective view of a portion of the cleaner head, showing assembly of the main control valve.
Figure 9:
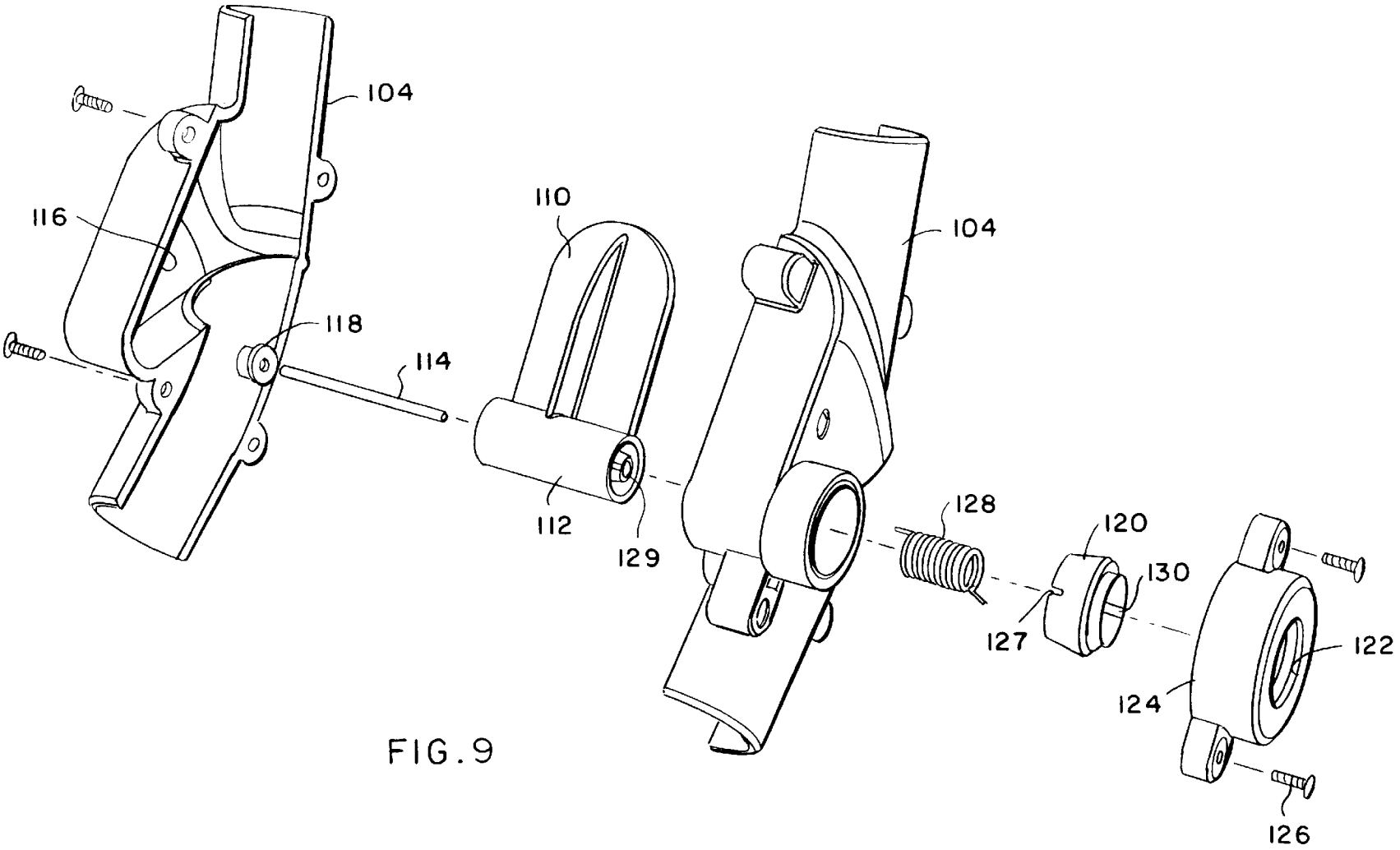
FIG. 9 is an exploded perspective view of a portion of the cleaner head, showing assembly of a bypass valve for regulating water flow through a bypass suction tube.

The bypass valve 106 is mounted within the bypass suction tube 104, and is adapted for cyclic movement between a normally closed position and a pressure responsive open position in coordination with the cyclic operation of the main control valve 16. In one preferred form as shown in FIGS. 6, 7 and 9, the bypass valve 106 comprises a valve flap 110 protruding from a sleeve base 112 carried on a shaft 114 extending laterally across a pocket 116 formed along the length of the bypass tube 104. In this regard, the illustrative bypass tube is formed by interconnected longitudinally mated tube halves, with one end of the valve shaft 114 carried by a bushing 118 on one tube half and the opposite shaft end carried by an adjustment hub 120. The adjustment hub 120 is seated within an open port 122 in a friction collar 124 fastened onto the opposite tube half by screws 126 or the like. A biasing spring 128 of suitable configuration is provided, such as the illustrative coil spring with its opposite ends seated within slots 127 and 129 (FIG. 9) formed respectively within the adjustment hub 120 and an outboard face of the sleeve base 112, so that the torsion-type spring 128 applies a selected biasing force urging the valve flap 110 toward a normal position extending across and closing the bypass suction tube 104 (FIG. 6). The specific magnitude of this biasing force may be adjustably selected by rotatably positioning the adjustment hub 120 within the friction collar 124, by means of an exposed adjustment slot 130 on an outboard face of the hub 120.

During operation, with the bypass suction tube 104 and the related bypass valve 106, the normally open main control valve 16 is pivotally displaced between the open and substantially closed positions to induce pressure fluctuations or pulsations for forwardly driving the pool cleaner in incremental steps, as previously described. When the main valve 16 is drawn to the substantially closed position, the vacuum within the primary suction tube 42 momentarily increases to a level sufficient to draw the bypass valve 106 from the normally closed position to the open position, as viewed in FIG. 7. That is, the increased vacuum, or decreased pressure level, along the primary suction tube 42 causes the bypass valve flap 110 to swing upwardly in the downstream-flow direction to the open position to permit water flow upwardly through the bypass tube 104 and further through the vacuum hose 14 to the pool filtration system 12. This timed opening of the bypass suction tube 104, and the accompanying surge flow of water therethrough, effectively enhances the forward step-wise transport of the pool cleaner during operation. When the main valve 16 returns to the open position, the vacuum level in the primary suction tube 42 is partially relieved to permit the biasing spring 128 to return the bypass valve flap 110 to the closed position. Accordingly, with this construction, the bypass valve 106 is cyclically opened and closed in opposition to or out of phase with the main control valve 16, whereby the cleaner is effectively driven forwardly in incremental steps yet water flow through the cleaner head to the vacuum hose 14 is substantially continuous by alternate flow through the primary and bypass suction tubes 42 and 104.

The forward motion of the pool cleaner 10 desirably follows a nonlinear path to achieve random travel throughout the swimming pool, so that the cleaner will pick up settled debris from substantially all submerged surfaces of the pool within a relatively short period of time. To achieve this nonlinear motion, the pattern of perforations 92 formed in the resilient disk 36 is formed in an asymmetric pattern as shown best in FIG. 5 with more open hole area at one lateral side of the central disk opening 56 than at the other. With this configuration, the side of the disk associated with the smaller open hole area is retained by the vacuum flow through the suction inlet 34 with a greater force, resulting in increased friction between the disk 36 and the underlying pool surface 38 as the cleaner moves forwardly in small steps. This nonuniform frictional resistance between the disk and the pool surface causes the cleaner to turn slightly upon each forward step, whereby the cleaner moves forwardly with a slight turning motion. Within a swimming pool having variable depth and curved transition regions between the floor and side walls, the result is an enhanced overall randomness of travel.

The nonlinear forward motion of the cleaner may be further enhanced by providing a nonperforate apron 132 (FIG. 5) overlying a selected arcuate segment of the resilient disk 36 at one lateral side of the cleaner head 30. As shown, this apron 132 may include a mounting ring 134 at one side thereof for assembly about the housing members 48, 50 of the cleaner head, at a location sandwiched between the upper side of the disk 36 and the upper lock rim 59. In this regard, the lock rim 59 formed cooperatively by the two housing members 48, 50 conveniently includes a pair of gaps at the front and rear for seated reception of upstanding ears 136 (FIGS. 4–7) on the mounting ring 134 to insure nonrotational mounting and correct rotational alignment of the apron 132 relative to the cleaner head. From the mounting ring 134, the apron 132 comprises a part-circular arcuate and flexible rubber or plastic sheet segment extending radially outwardly from one side of the cleaner head 30, to overlie and close the perforations 92 formed therebelow in the resilient disk 36. Closure of these perforations increases the frictional resistance between the disk 36 and the pool surface 38 at that side of the cleaner head, to contribute further to forward cleaner travel with a nonlinear turning motion. Moreover, if desired, the nonlinear path of travel and overall random travel characteristics may be further enhanced by sizing the central opening 56 in the disk 36 to permit rotation of the disk with its asymmetric pattern of perforations 92 about the cleaner head 30, such that the asymmetric forces causing the cleaner to turn will also cause the disk 36 to rotate slightly upon each incremental forward step. The result is that the frictional resistance between the pool surface and the disk portion underlying the apron 132 varies according to the rotational position of the disk, whereby the curvature of the nonlinear forward path is not constant.

In accordance with a further aspect of the invention, the geometry of the housing members 48, 50 conveniently permits partial disassembly to access the main control valve 16, without requiring disassembly of the disk 56. More particularly, as depicted best in FIG. 5, by forming the annular lower foot 32 and the related foot flange 54 on the first housing member 48, together with a portion of the upper lock rim 59, the second housing member 50 can be disassembled to permit access to the plenum chamber 40 and the control valve 16 therein in the event that service or maintenance is required. Such removal of the second housing member 50 may be performed without removing the resilient disk 36 or the related overlying apron 132. Alternatively, if desired, the housing members 48, 50 may be constructed as a one-piece component, with service access to the control valve 16 being permitted through the laterally open mounting collar 80 upon removal of the cap 78.

Moreover, in the event that the cleaner 10 attempts to pick up debris sufficiently large to obstruct the entire suction inlet 34 at the foot of the cleaner head 30, auxiliary inflow ports are provided to insure at lest some sustained water flow through the cleaner in order to prevent undesired cavitation burn-out of the filtration pump 18. Such auxiliary inflow ports 138 are formed in the housing members 48, 50 (FIGS. 2 and 5), and additional auxiliary inflow ports 140 are formed in the outer housing 28 (FIGS. 1 and 2).

The improved suction powered pool cleaner of the present invention thus provides a ball-type main control valve 16 mounted for cyclic movement to induce pressure fluctuations or pulsations for driving the cleaner forwardly in a succession of incremental steps, with the ball-type valve moving to an open position accommodating substantially unobstructed flow of water-borne debris in a manner which is resistant to clogging. Moreover, the additional bypass suction tube 104 and related bypass valve 106 provide an additional flow path positioned especially for suctioning large debris. The resilient disk 56 provides asymmetric frictional forces causing the pool cleaner to advance along a nonlinear path for improved randomness of travel.

A variety of further modifications and improvements in and to the suction powered pool cleaner of the present invention will be apparent to those persons skilled in the art. For example, the decorative external housing 28 could be omitted and the functional components thereof including the nose wheel 46 and the carrying handle 44 could be provided as a portion of the exterior geometry of the cleaner head 30. Moreover, while a ball-type valve head 64 is shown and described to form the main control valve 16, it will be understood and appreciated that alternative valve head configurations may be employed. Further, while the optional bypass valve 106 is shown in the form of a spring-loaded valve flap 110, alternative bypass valve geometries may be used such as a resilient diaphragm valve of the type shown and described in U.S. Pat. No. 5,634,229. Accordingly, no limitation is intended by way of the foregoing description and accompanying drawings, except as set forth in the appended claims.

What is claimed is:

1. A pool cleaner for connection to a suction source, said pool cleaner comprising:

a cleaner head including housing means forming a plenum chamber and a downwardly open suction inlet for inflow of water and water-borne debris from a submerged surface of a swimming pool into said plenum chamber, said cleaner head further including a primary suction tube having a first end coupled to said housing means in flow communication with said plenum chamber and a second end adapted for connection to a suction source, said primary suction tube extending angularly upwardly and forwardly from said housing means, and said first end of said primary suction tube defining an annular valve seat; and a control valve including a valve head mounted pivotally within said plenum chamber for movement between an open position disposed substantially at one side of said valve seat to permit substantially unobstructed flow of water from said plenum chamber to said primary suction tube, and a substantially closed position disposed in close proximity with said valve seat to substantially obstruct flow of water from said plenum chamber to said primary suction tube;

said control valve including biasing means for spring-loading said valve head normally to said open position, whereby suction flow of water from said plenum chamber to said primary suction tube draws said valve head from said open position to said substantially closed position to momentarily interrupt the water flow to said primary suction tube and induce a pressure pulsation effective to drive said cleaner head forwardly in a small incremental step and permit spring-loaded return movement of said valve head toward said open position.

2. The pool cleaner of claim 1 wherein said valve head comprises a ball segment.

3. The pool cleaner of claim 1 wherein said biasing means comprises a biasing spring.

4. The pool cleaner of claim 3 further including means for adjustably setting the spring force biasing said valve head.

5. The pool cleaner of claim 1 wherein said valve seat is formed from a resilient material.

6. The pool cleaner of claim 5 wherein said valve seat has a relatively thin leading edge.

7. The pool cleaner of claim 1 wherein said control valve further includes stop means for maintaining said valve head in at least slightly spaced relation with said valve seat, when said valve head is in said substantially closed position.

8. The pool cleaner of claim 7 wherein said valve seat is formed from a resilient material.

9. The pool cleaner of claim 1 further including an external housing on said cleaner head, said external housing rotatably supporting a nose wheel generally at a front end thereof.

10. The pool cleaner of claim 9 wherein said external housing further includes a carrying handle.

11. The pool cleaner of claim 1 further including a flexible disk carried by said cleaner head and extending radially outwardly therefrom for contacting a submerged pool surface in surrounding relation to said suction inlet, said disk having a pattern of perforations formed therein.

12. The pool cleaner of claim 11 wherein said pattern of perforations formed in said disk is laterally asymmetric.

13. The pool cleaner of claim 12 wherein said disk is rotatably mounted on said cleaner head.

14. The pool cleaner of claim 11 further including an apron carried by said cleaner head and extending laterally at one side thereof, said apron overlying a segment of said disk to obstruct water flow through a portion of the perforations formed in said disk.

15. The pool cleaner of claim 14 wherein said apron is formed from a flexible material.

16. The pool cleaner of claim 14 wherein said disk is rotatably mounted on said cleaner head, said apron being nonrotatably mounted on said cleaner head.

17. The pool cleaner of claim 11 wherein said housing means comprises at least two housing members interconnected to define said plenum chamber having said control valve mounted therein, said housing members being adapted for disassembly to permit access to said control valve without requiring disassembly of said disk from said cleaner head.

18. The pool cleaner of claim 17 wherein said suction inlet is defined by one of said housing members.

19. The pool cleaner of claim 1 wherein said housing means further defines at least one auxiliary water inflow port for water inflow to said plenum chamber.

20. The pool cleaner of claim 1 further including means for mounting said control valve within said plenum chamber, said mounting means including means accessible from the exterior of said cleaner head for adjustably setting the biasing force applied to said valve head.

21. The pool cleaner of claim 20 wherein said means for adjustably setting said biasing force includes at least one flow aperture to permit water inflow therethrough into said plenum chamber.

22. The pool cleaner of claim 1 wherein said cleaner head further includes a suction bypass tube having a first end defining a bypass inlet disposed in spaced relation to said suction inlet, and a second end coupled in flow communication with said suction source, and further comprising a bypass valve movable between a closed position substantially restricting water flow through said bypass suction tube and an open position permitting increased water flow through said bypass suction tube, said bypass valve being responsive to pressure within said primary suction tube for movement to said open position when said valve head of said control valve is in said substantially closed position, and for movement of said bypass valve toward said closed position when said control valve head is in said open position.

23. The pool cleaner of claim 22 wherein said second end of said bypass suction tube is coupled in flow communication with said primary suction tube at a location downstream from said valve seat.

24. The pool cleaner of claim 22 wherein said bypass valve is spring-loaded normally to said closed position, and further including means accessible from the exterior of said cleaner head for adjustably setting the biasing force applied to said bypass valve.

25. The pool cleaner of claim 22 wherein said bypass inlet defined by said bypass suction tube is spaced forwardly from said suction inlet.

26. The pool cleaner of claim 22 further including a flexible perforated disk carried by said cleaner head and extending radially outwardly therefrom for contacting a submerged pool surface in surrounding relation to said suction inlet, said bypass inlet defined by said bypass suction tube opening above said disk and forwardly from said suction inlet.

27. The pool cleaner of claim 1 wherein said valve head in said open position is disposed substantially out of alignment with a centerline of said primary suction tube.

28. A pool cleaner for connection to a suction source, said pool cleaner comprising:

a cleaner head defining a downwardly open suction inlet for inflow of water and water-borne debris from a submerged surface of a swimming pool and including means for coupling said suction inlet to a suction source;

drive means responsive to water flow through said cleaner head from said suction inlet to the suction source for driving said cleaner head to travel generally in a forward direction within the swimming pool; and a flexible disk carried by said cleaner head and extending radially outwardly therefrom for contacting a submerged pool surface in surrounding relation to said suction inlet, said disk having a pattern of perforations formed therein in a laterally asymmetric pattern, whereby water flow through the perforations in said disk to said suction inlet results in laterally asymmetric frictional resistance between said disk and the submerged pool surface to cause said cleaner head to travel along a nonlinear path of movement.

29. The pool cleaner of claim 28 wherein said disk is rotatably mounted on said cleaner head.

30. The pool cleaner of claim 29 further including an apron carried by said cleaner head and extending laterally at one side thereof, said apron overlying a segment of said disk to obstruct water flow through a portion of the perforations formed therein.

31. The pool cleaner of claim 30 wherein said apron is formed from a flexible material.

32. The pool cleaner of claim 30 wherein said apron is nonrotatably mounted on said cleaner head.

33. A pool cleaner for connection to a suction source, said pool cleaner comprising:

a cleaner head defining a downwardly open suction inlet for inflow of water and water-borne debris from a submerged surface of a swimming pool and including means for coupling said suction inlet to a suction source;

drive means responsive to water flow through said cleaner head from said suction inlet to the suction source for driving said cleaner head to travel generally in a forward direction within the swimming pool;

a flexible disk rotatably carried by said cleaner head and extending radially outwardly therefrom for contacting a submerged pool surface in surrounding relation to said suction inlet, said disk having a pattern of perforations formed therein; and an apron nonrotatably carried by said cleaner head and extending laterally at one side thereof to overlie a segment of said disk to obstruct water flow through the disk perforations formed in said disk segment, whereby water flow through the perforations in said disk to said suction inlet results in laterally asymmetric frictional resistance between said disk and the submerged pool surface to cause said cleaner head to travel along a nonlinear path of movement.

34. The pool cleaner of claim 33 wherein said apron is formed from a flexible material.

35. A pool cleaner for connection to a suction source, said pool cleaner comprising:

a cleaner head including housing means forming a plenum chamber and a downwardly open suction inlet for inflow of water and water-borne debris from a submerged surface of a swimming pool into said plenum chamber, said cleaner head further including a primary suction tube having a first end coupled to said housing means in flow communication with said plenum chamber and a second end adapted for connection to a suction source, said primary suction tube extending angularly upwardly and forwardly from said housing means, and said first end of said primary suction tube defining an annular valve seat;

a control valve including a valve head mounted pivotally within said plenum chamber for movement between an open position disposed substantially at one side of said valve seat to permit substantially unobstructed flow of water from said plenum chamber to said primary suction tube, and a substantially closed position disposed in close proximity with said valve seat to substantially obstruct flow of water from said plenum chamber to said primary suction tube;

said control valve including biasing means for spring-loading said valve head normally to said open position, whereby suction flow of water from said plenum chamber to said primary suction tube draws said valve head from said open position to said substantially closed position to momentarily interrupt the water flow to said primary suction tube and induce a pressure pulsation effective to drive said cleaner head forwardly in a small incremental step and permit spring-loaded return movement of said valve head toward said open position;

said cleaner head further including a suction bypass tube having a first end defining a bypass inlet disposed in spaced relation to said suction inlet, and a second end coupled in flow communication with said suction source; and a bypass valve movable between a closed position substantially restricting water flow through said bypass suction tube and an open position permitting increased water flow through said bypass suction tube, said bypass valve being responsive to pressure within said primary suction tube for movement to said open position when said valve head of said control valve is in said substantially closed position, and for movement of said bypass valve toward said closed position when said control valve head is in said open position.

36. The pool cleaner of claim 35 wherein said second end of said bypass suction tube is coupled in flow communication with said primary suction tube at a location downstream from said valve seat.

37. The pool cleaner of claim 35 wherein said bypass valve is spring-loaded normally to the closed position, and further including means accessible from the exterior of said cleaner head for adjustably setting the biasing force applied to said bypass valve.

38. The pool cleaner of claim 35 wherein said bypass inlet defined by said bypass suction tube is spaced forwardly from said suction inlet.

39. The pool cleaner of claim 35 further including a flexible perforated disk carried by said cleaner head and extending radially outwardly therefrom for contacting a submerged pool surface in surrounding relation to said suction inlet, said bypass inlet defined by said bypass suction tube opening above said disk and forwardly from said suction inlet.

40. The pool cleaner of claim 35 wherein said bypass suction tube extends generally in parallel with said primary suction tube.

41. The pool cleaner of claim 35 further including means accessible from the exterior or said cleaner head for adjustably setting the spring force biasing said valve head.

42. The pool cleaner of claim 35 wherein said valve seat is formed from a resilient material.

43. The pool cleaner of claim 42 wherein said control valve further includes stop means for maintaining said valve head in at least slightly spaced relation with said valve seat, when said valve head is in said substantially closed position.

44. The pool cleaner of claim 35 further including a flexible disk carried by said cleaner head and extending radially outwardly therefrom for contacting a submerged pool surface in surrounding relation to said suction inlet, said disk having a pattern of perforations formed therein.

45. The pool cleaner of claim 44 wherein said pattern of perforations formed in said disk is laterally asymmetric.

46. The pool cleaner of claim 44 wherein said disk is rotatably mounted on said cleaner head, and further including an apron nonrotatably carried by said cleaner head and extending laterally at one side thereof, said apron overlying a segment of said disk to obstruct water flow through a portion of the perforations formed in said disk.

* * * * *